US009919352B2

(12) United States Patent
Bryant et al.

(10) Patent No.: US 9,919,352 B2
(45) Date of Patent: Mar. 20, 2018

(54) APPARATUS AND METHOD FOR STABILIZING A FORMABLE MATERIAL WHILE FORMING

(71) Applicant: Spirit AeroSystems, Inc., Wichita, KS (US)

(72) Inventors: William Joseph Bryant, Wichita, KS (US); Trevor Scott Angell, Andover, KS (US); Matthew Ryan Schroeder, Wichita, KS (US)

(73) Assignee: Spirit AeroSystems, Inc., Wichita, KS (US)

( * ) Notice: Subject to any disclaimer, the term of this patent is extended or adjusted under 35 U.S.C. 154(b) by 205 days.

(21) Appl. No.: 14/979,988

(22) Filed: Dec. 28, 2015

(65) Prior Publication Data

US 2017/0182540 A1 Jun. 29, 2017

(51) Int. Cl.

| | |
|---|---|
| ***B21D 26/033*** | (2011.01) |
| ***B21D 26/021*** | (2011.01) |
| ***B21D 47/00*** | (2006.01) |
| ***B21D 53/92*** | (2006.01) |
| ***B21D 26/02*** | (2011.01) |
| ***B21D 22/12*** | (2006.01) |
| ***B21D 22/10*** | (2006.01) |

(52) U.S. Cl.

CPC ..... *B21D 26/021* (2013.01); *B21D 22/105* (2013.01); *B21D 22/12* (2013.01); *B21D 22/125* (2013.01); *B21D 26/02* (2013.01); *B21D 26/033* (2013.01); *B21D 47/00* (2013.01); *B21D 53/92* (2013.01)

(58) Field of Classification Search

CPC ..... B21D 26/021; B21D 47/00; B21D 53/92; B21D 26/033; B21D 22/12; B21D 26/02; B21D 22/125; B21D 22/105

USPC ..... 72/63

See application file for complete search history.

(56) References Cited

U.S. PATENT DOCUMENTS

| | | | | |
|---|---|---|---|---|
| 2,375,599 A * | 5/1945 | Walton | B21D 22/12 | 72/63 |
| 2,787,973 A * | 4/1957 | Heidmann | B21D 22/125 | 72/19.9 |
| 3,670,546 A * | 6/1972 | De La Sierra | B21D 26/02 | 72/63 |
| 3,698,337 A * | 10/1972 | Brawner | B21D 22/105 | 72/352 |
| 6,779,374 B1 * | 8/2004 | Roldan | B21D 22/12 | 29/421.1 |

(Continued)

*Primary Examiner* — David B Jones
(74) *Attorney, Agent, or Firm* — Hovey Williams LLP

(57) ABSTRACT

An apparatus and method configured for manufacturing an aircraft part from formable material. The apparatus may include one or more rigid forming components onto which the formable material is placed and between which non-flange portions of the formable material may be compressed, and at least one inflatable component that, when expanded by inflation, presses flange portions of the formable material against at least one of the rigid forming components. The inflation component(s) may be arranged in any configuration for forming the formable material into C-shaped channels, single L-shaped channels, or opposing Z-shaped channels. Once pressed between the rigid forming components and/or the inflated inflatable components, the formable material may be heated for forming according to the particular formable material used.

18 Claims, 6 Drawing Sheets

(56) References Cited

U.S. PATENT DOCUMENTS

2013/0160512 A1* 6/2013 Chen ..... B21D 26/033
72/63

* cited by examiner

APPARATUS AND METHOD FOR STABILIZING A FORMABLE MATERIAL WHILE FORMING

BACKGROUND

Many modern aircraft components are made of composite material. Forming of the composite material into a desired aircraft component may be achieved using a variety of composite manufacturing techniques, such as hand lay-up, drape forming, press forming, and automatic fiber placement (AFP). These methods may all be prone to strain and wrinkling of the composite material when forming parts having extreme curvature or complex curvatures and have various other disadvantages, as described below.

Hand lay-up is a labor intensive process and requires single ply application of multiple layers of composite material to a formed surface to form a part. Hand lay-up also involves several vacuum compaction cycles to remove trapped air and consolidate composite plies. These vacuum compaction cycles require expensive consumable materials, such as elastomeric vacuum bags, which must be discarded after the part is completed.

Drape forming or hot drape forming is a process using a vacuum chamber defined by an elastomeric material sealed around uncured composite material placed on a single form block. The uncured composite material is then heated before atmosphere is evacuated from the vacuum chamber. This causes external atmosphere to push against the elastomeric material, thereby pressing the composite material against the form block. However, this process is limited to forming only one or two flanges in the same direction simultaneously and straight or slightly-curved parts.

Press forming is a process using heavy and expensive equipment to form flanges of a composite part. Press forming generally requires two form dies, one acting as a base for the material to form to and the other die acting as a pusher. However, like drape forming, press forming is generally limited to forming only one or two flanges in the same direction simultaneously and straight or slightly-curved parts.

AFP is a process using heavy and expensive equipment to place multiple layers of individual strips of uncured composite material, such as prepreg tow, onto a form block or shape. This process is time consuming and is generally limited to forming only one or two flanges in the same direction.

SUMMARY OF THE INVENTION

Embodiments of the present invention solve the above-mentioned problems and provide a distinct advance in the art of forming a formable material into a rigid part.

One embodiment of the invention is a method of manufacturing an aircraft part from formable material, including the steps of placing the formable material on a rigid forming component, then actuating expansion of one or more inflatable components, such that the inflatable components press flange portions of the formable material against the rigid forming component. Then the method may include a step of forming the formable material while the formable material is pressed between the inflatable component and the rigid forming component.

Another embodiment of the invention is a part forming apparatus for shaping a formable material into a rigid part having angled flanges. The part forming apparatus may include two holding chambers, two rigid forming components each fixed within one of the holding chambers, a first pressure source, and at least one inflatable component. The two holding chambers may be actuatable between a first open configuration and a second closed configuration in which the two holding chambers cooperatively form a single substantially enclosed holding chamber, and the two rigid forming components may be aligned and configured to compress the forming material when the two holding chambers are in the second closed configuration with the forming material disposed between the two rigid forming components. The inflatable component may be fixed relative to at least one of the rigid forming components and at least one of the holding chambers, and may be fluidly coupled with the first pressure source for inflation thereof when the two holding chambers are in the second closed configuration.

Yet another embodiment of the invention includes a part forming apparatus for shaping a formable material into a rigid part, and includes at least one rigid forming component, at least one holding chamber, and at least one inflatable sheet sealed to the at least one holding chamber. The rigid forming component may be sized and shaped according to a desired size and shape of at least one surface of the rigid part. The inflatable sheet may be fluidly coupled with at least one pressure source for inflation thereof, and may be positioned such that, when at least partially inflated, the inflatable sheet presses toward and against the at least one rigid forming component.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 7:
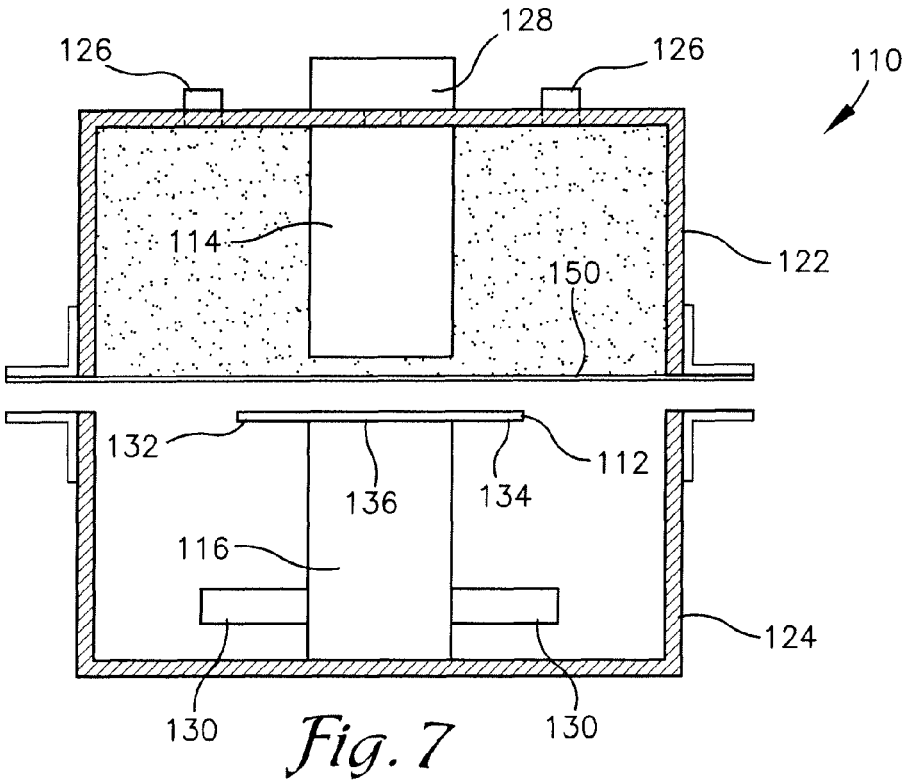
FIG. 7 is a schematic cross-sectional view of an alternative embodiment of the part forming apparatus of FIG. 3, replacing the two inflatable components with a sheet of inflatable material and positioned in a first open configuration.
Figure 8:
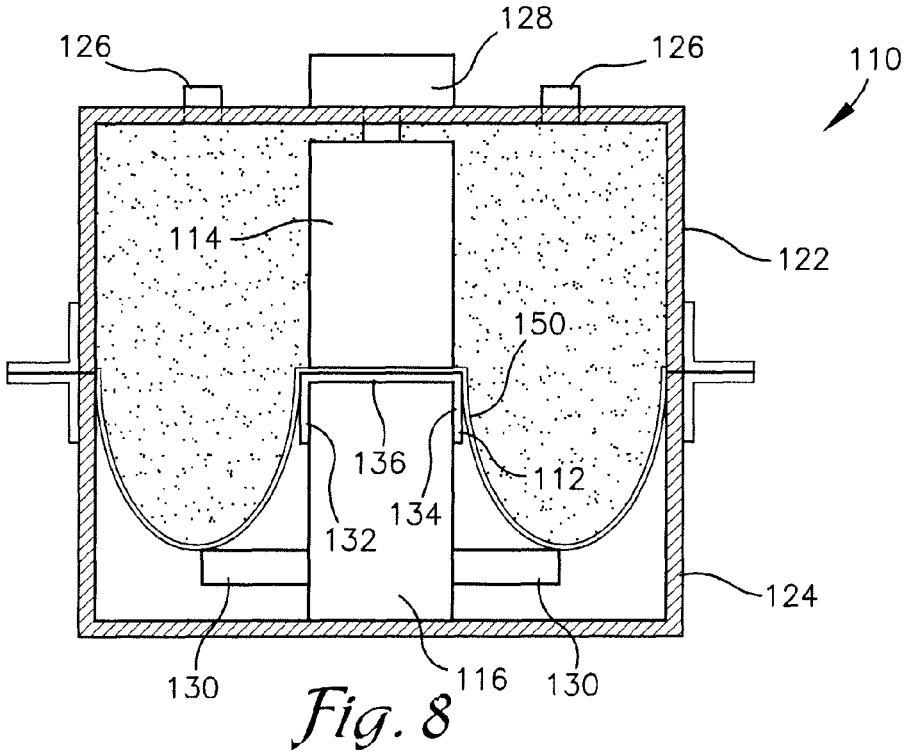
FIG. 8 is a schematic cross-sectional view of the alternative embodiment of the part forming apparatus of FIG. 7 positioned in a second closed configuration with the sheet of inflatable material inflated.
Figure 10:
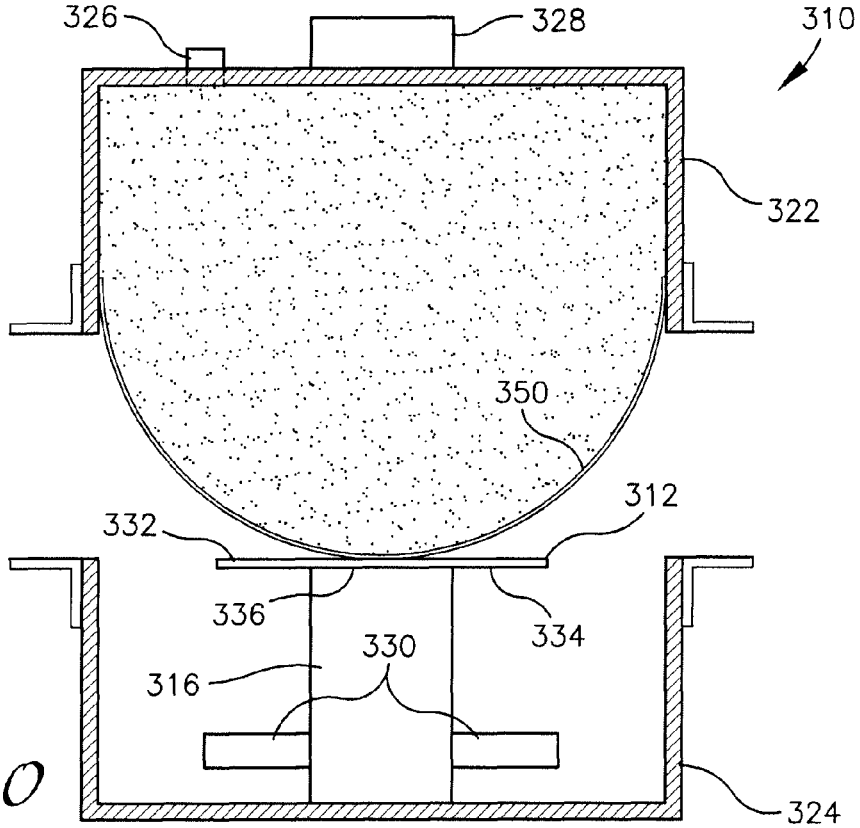
Figure 11:
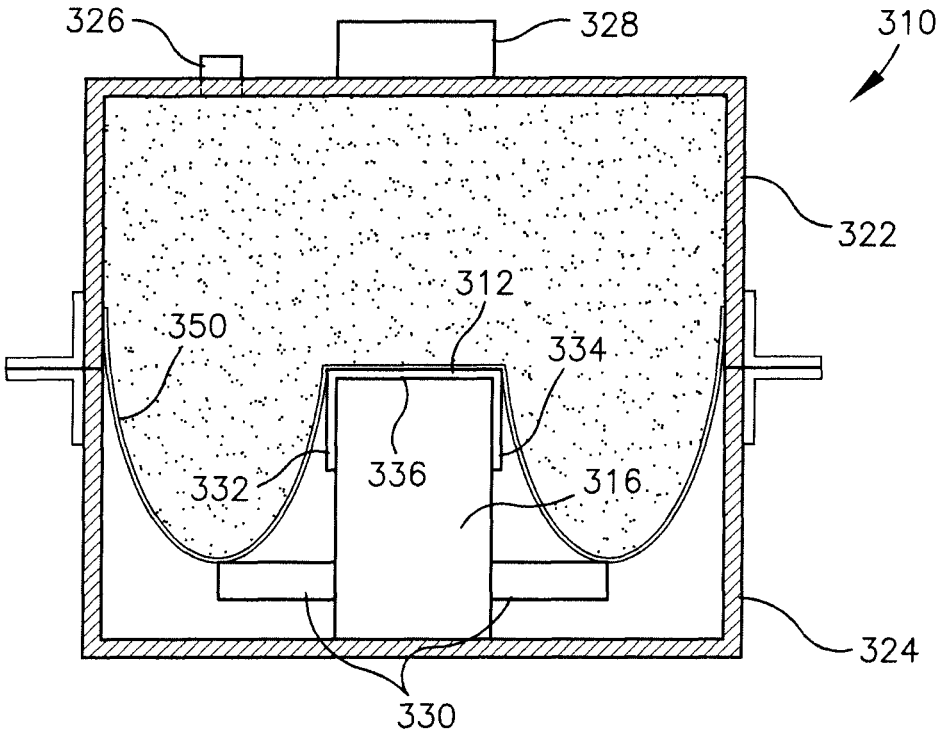

FIG. 10 is a schematic cross-sectional view of an alternative embodiment of the part-forming apparatus of FIGS. 7 and 8, in an open configuration with one of the rigid forming components omitted, such that compression for the non-flange portion and the flange portions of the formable material are applied by the sheet of inflatable material; and FIG. 11 is a schematic cross-sectional view of the part-forming apparatus of FIG. 10 in a closed configuration.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

A part forming apparatus 10, constructed in accordance with embodiments of the present invention, is illustrated in FIGS. 1-5. The part forming apparatus 10 is configured to form any formable material 12 into a rigid part, such as aircraft body frames or the like, having any desired shape or configuration. In particular, the part forming apparatus 10 is configured to form flanges for curved or complex-curved parts while avoiding wrinkling and buckling of the formable material 12. The part forming apparatus 10 comprises one or two rigid forming components 14,16, one or two inflatable components 18,20, one or two holding chambers 22,24, one or more pressure sources 26,28, and at least one heat source 30.

The formable material 12 may be any formable, shapeable material, such as uncured composite material, thermal plastics, aluminum, formable metals, and the like. The formable material 12 may be, for example, stacked layers of uncured composite ply or composite prepreg tow. Composite material, as is known in the art, generally includes at least two constituent components—a reinforcement material and a matrix material. The reinforcement material generally provides mechanical strengthening properties, such as high tensile strength, to the composite material, while the matrix material acts as a binder to hold the reinforcement material together. The reinforcement material and the matrix material may possess additional properties not discussed herein. Furthermore, the composite material may include additional components not discussed herein.

Examples of the reinforcement material that may be used include, but are not limited to, fiber materials such as carbon fiber, boron fiber, fiberglass, aramid fiber, ceramic fiber, and the like. In the case of fiber-based reinforcement materials, the fiber may exist in one of at least two forms—either preimpregnated (prepreg), in which the fiber may be coated with a matrix material that is uncured, such as uncured resin, or as dry fiber, with no matrix material incorporated prior to part manufacture. The matrix material may typically be in the form of polymer resins, such as epoxies, bismaleimides, vinyl esters, and the like, among others.

Figure 1:
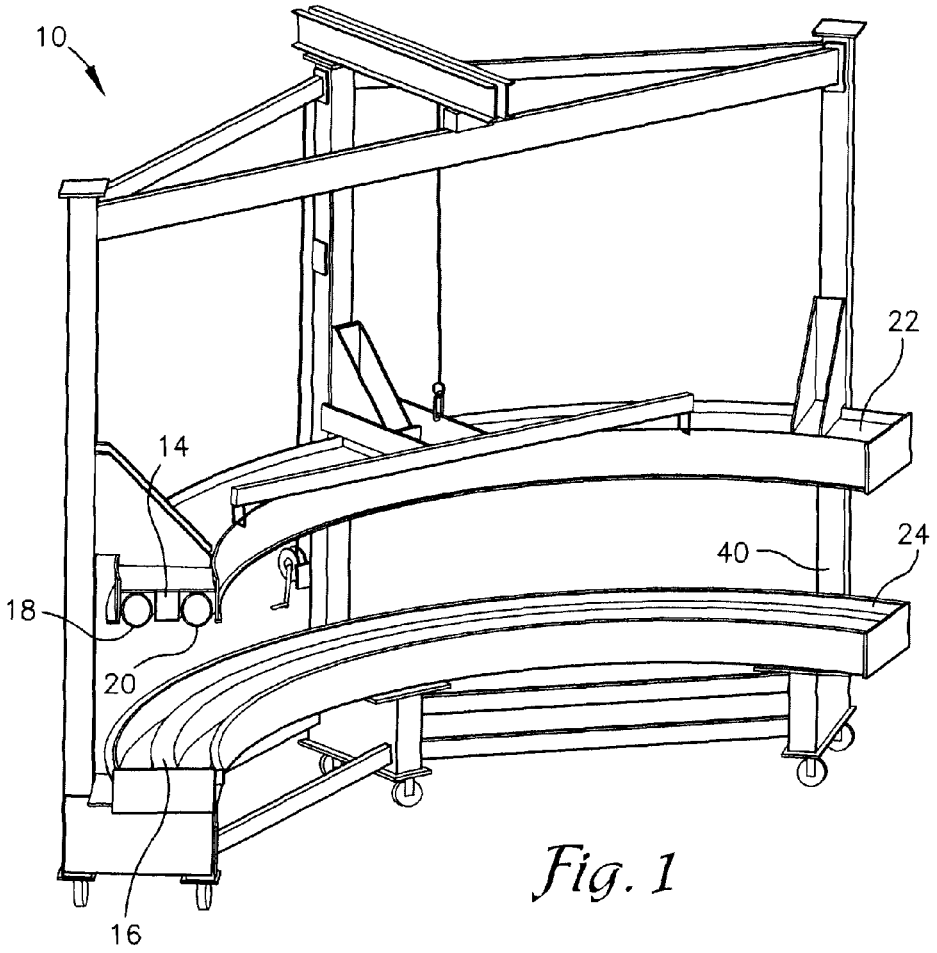
FIG. 1 is a perspective view of a part forming apparatus constructed according to embodiments of the present invention.
Figure 3:
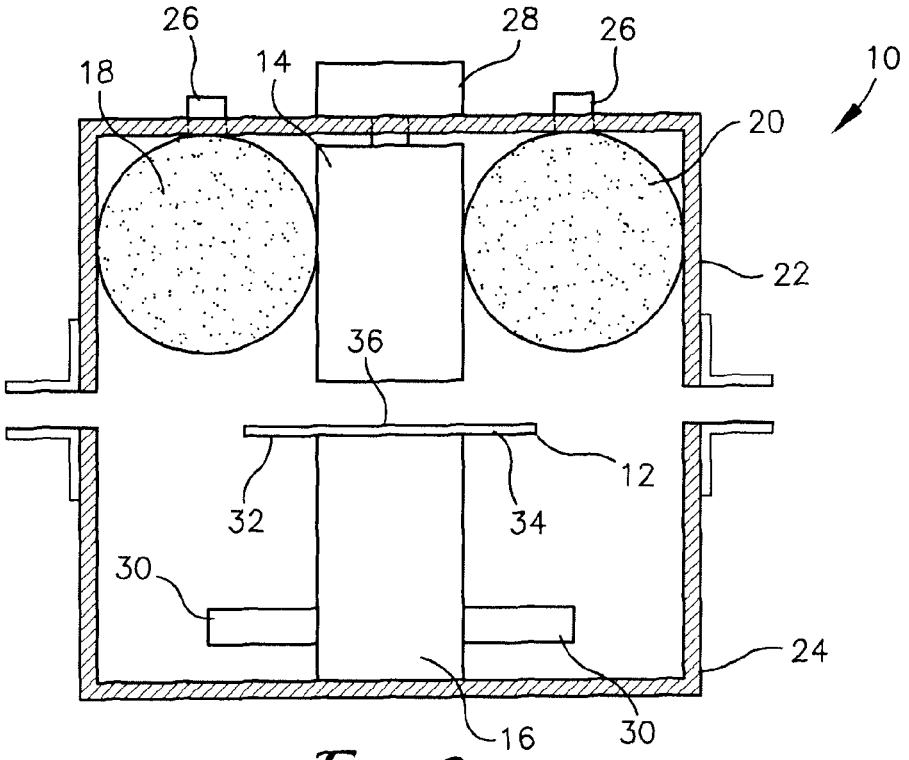
FIG. 3 is a schematic cross-sectional view of the part forming apparatus of FIG. 1 in a first open configuration with a formable material placed therein.
Figure 4:
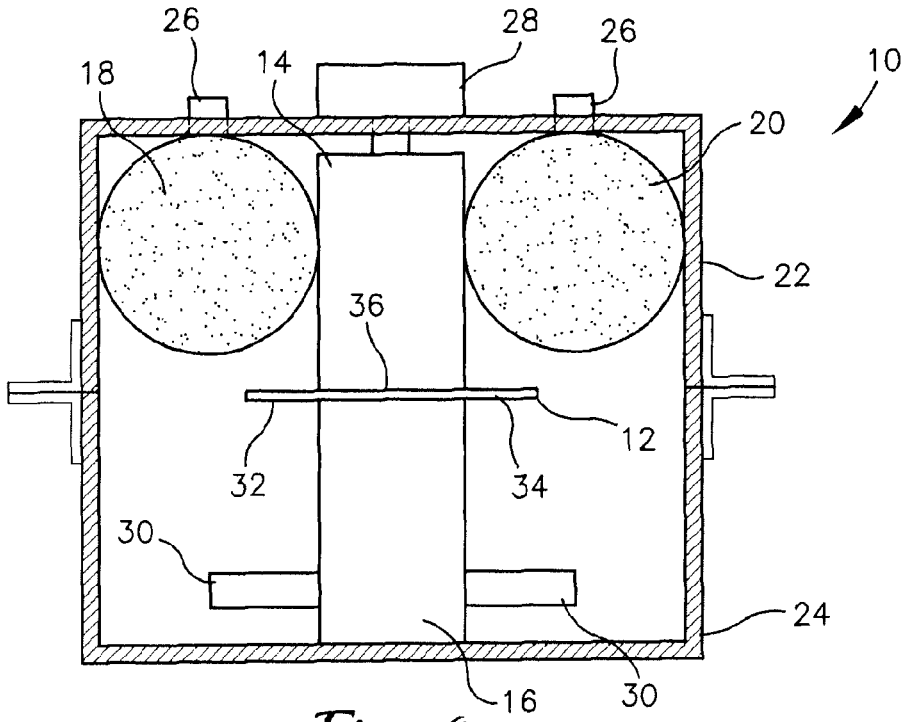
FIG. 4 is a schematic cross-sectional view of the part forming apparatus of FIG. 1 in a second closed configuration with the formable material placed therein.
Figure 5:
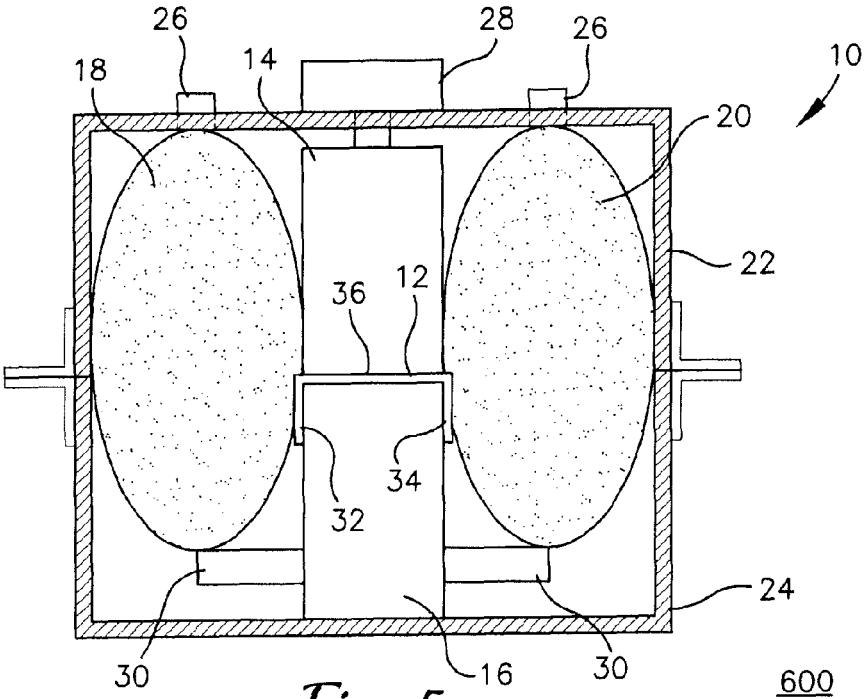
FIG. 5 is a schematic cross-sectional view of the part forming apparatus of FIG. 1 in the second closed configuration with two inflatable components thereof inflated to compress flange portions of the formable material.

The rigid forming components 14,16 may be compression blocks, forming dies, plates, or any rigid surface configured to correspond with a desired shape and configuration of the composite part to be formed thereon. For example, as illustrated in FIG. 1, the rigid forming components 14,16 may each be substantially C-shaped compression blocks for forming a C-shaped composite part having a Z-shaped or C-shaped cross section. In some embodiments of the invention, as illustrated in FIGS. 3-5, the rigid forming components may comprise a first rigid forming component 14 and a second rigid forming component 16, and the rigid forming components 14,16 may be laterally aligned with each other, such that at least a portion of the formable material 12 may be compressed therebetween. The rigid forming components 14,16 may be made of epoxy board, carbon fiber, tooling foam, steel, or any substantially rigid material known in the art and capable of retaining its shape under composite cure heat and pressure.

The inflatable components 18,20 may be any substantially air-tight, flexible, inflatable material with high elongation, such as an elastomeric material, silicone rubber, or the like. In some embodiments of the invention, the inflatable components 18,20 may be made of silicone rubber between 0.05 and 0.5 inches thick, or, for example, $\frac{1}{8}^{th}$ inch thick. The inflatable components 18,20 may also be reusable after exposure to the heat required for forming the composite material. In some embodiments of the invention, the inflatable components 18,20 may comprise two hollow bladders made of inflatable material. For example, both of the two hollow bladders may be mounted in fixed relation to the first rigid forming component 14 and located at opposing sides of the first rigid forming component 14, as illustrated in FIGS. 3-5. However, other locations and configurations of the inflatable components 18,20 may be used without departing from the scope of the invention, as described in detail below.

In one embodiment of the invention, as illustrated in FIGS. 3-5, the inflatable components 18,20 may comprise a first air bladder 18 and a second air bladder 20. The first and second air bladders 18,20 may have any shape or configuration required for forming a given composite part. The first and second air bladders 18,20 may be hollow and substantially sealed, and openings or ports may be formed anywhere therethough the first and second air bladders 18,20 for evacuating air from or forcing air or gas into the first and second air bladders 18,20. For example, as illustrated in FIGS. 3-5, the first and second air bladders 18,20 may be hollow cylinders sealed on one end and fluidly coupled to one of the pressure sources 26,28 at another end. However, any method of creating a pressure differential to elongate and urge the inflatable components 18,20 in a desired direction may be used without departing from the scope of the invention.

As illustrated in FIG. 1, the holding chambers 22,24 may be any rigid support components, frames, or housing for maintaining a desired location and alignment between the rigid forming components 14,16, the inflatable components 18,20, the heat source 30, and/or the formable material 12. For example, the holding chambers 22,24 may comprise two channels with C-shaped cross-sections which cooperatively form a hollow tube having a rectangular or square cross-section.

The holding chambers 22,24 may be actuatable toward and away from each other, allowing proper placement of the formable material 12 when open, and forming a single, substantially enclosed holding chamber when closed. In some embodiments of the invention, this actuation may be provided by one of the pressure sources 26,28, as later described herein. However, other methods of actuating the holding chambers 22,24 and/or the rigid forming components 14,16 toward each other may be used without departing from the scope of the invention. In some embodiments of the invention, as illustrated in FIG. 1, a frame 40 may support the holding chambers 22,24 and may provide a pathway or track for mechanical sliding or translation of one or both of the holding chambers 22,24 toward and away from each other. This sliding or translation of the holding chambers 22,24 relative to the frame 40 may be accomplished by mechanical, electro-mechanical, and/or hydraulic actuation, as described herein.

In some embodiments of the invention, the holding chambers 22,24 may create an air-tight chamber surrounding the inflatable components 18,20, the rigid forming components 14,16, and the formable material 12. However, in other embodiments of the invention, the holding chambers 22,24 may merely be frames or support components for other elements of the part forming apparatus 10, and need not mate or form an air-tight chamber for expansion or inflation of the inflatable components 18,20.

The pressure sources 26,28 may comprise air compressors, vacuums, or other devices operable to induce a pressure differential to inflate or elongate the inflatable components 18,20. In some embodiments of the invention, the pressure sources 26,28 may include a first pressure source 26 and a second pressure source 28. The first pressure source 26 may be fluidly coupled with the inflatable components 18,20 through an opening or port, such that when the first pressure source 26 is activated, air is pumped into the inflatable components 18,20. For example, as illustrated in FIGS. 3-5, the first pressure source 26 may pump air into the inflatable components 18,20, causing inflation thereof. Due to the shape of open space between the holding chambers 22,24 and the rigid forming components 14,16, the inflatable components 18,20 in FIG. 5 elongate toward the heat source, compressing flanges 32,34 of the formable material 12, thus creating a desired C-shaped cross section, with spaces between the flanges 32,34 referred to herein as the non-flange portion 36 of the formable material 12. Alternatively, the first pressure source 26 may be a vacuum which pulls or otherwise expands at least a portion of the inflatable components 18,20.

The second pressure source 28 may be coupled with one of the holding chambers 22,24 and may hydraulically actuate the holding chambers 22,24 toward and/or into direct contact with each other. Additionally or alternatively, the second pressure source may be coupled with one of the rigid forming components 14,16 and may hydraulically press one of the rigid forming components 14 into the formable material 12 resting on another of the rigid forming components 16, as illustrated in FIG. 4. However, as noted above, actuation of the rigid forming components 14,16 and/or the holding chambers 22,24 may be accomplished by any manual or automated actuation devices and methods known in the art without departing from the scope of the invention.

The heat source 30 may be any source of heat and may be located in any desired location on the part forming apparatus 10. For example, as illustrated in FIGS. 3-5, the heat source may be located between one of the rigid forming components 16 and one of the holding chambers 24. The heat source 30 may include, for example, infrared (IR) heaters or any other heat sources known in the art of composite part forming. In some embodiments of the invention, the heat source 30 may be mounted to and/or mounted adjacent one of the rigid forming components 14,16 proximate to the flanges 32,34 formed in the formable material 12.

Figure 2:
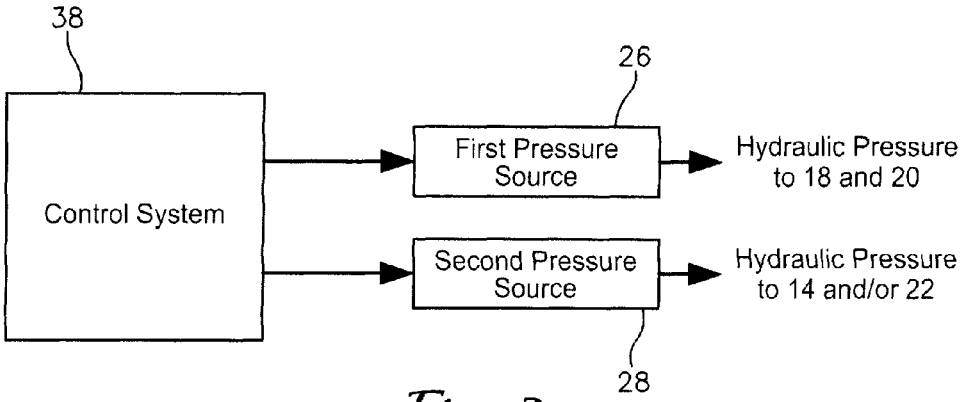
FIG. 2 is a flow diagram of a control system and pressure sources for actuating elements of the part forming apparatus of FIG. 1.

In some embodiments of the invention, control of the moveable or actuatable components described herein may be provided by way of a control system 38, as illustrated in FIG. 2. The control system 38 may be electrically, mechanically, and/or hydraulically coupled to activate the pressure sources 26,28, thereby activating inflation of the inflatable components 18,20 and/or actuation of the rigid forming components 14,16 and their corresponding holding chambers 22,24. The control system 38 may comprise any processors, circuitry, wires, memory storage devices, hardware, and/or software known in the art for controlling timing, amount, and sequencing of actuation of various components.

In some embodiments of the invention, the control system 38 may comprise a processor and/or computer-readable memory residing thereon or communicably coupled with the processor and may be configured for performing one or more of the method steps described herein. For example, the control system 38 may include any computer and/or server, such as a desktop computer, a laptop computer, a tablet, a mobile phone, or any other computing device having a data processor and computer-readable memory. The control system 38 may include or have access to hardware and software for receiving, storing, accessing, and transmitting information. The control system 38 may also comprise a display, such as a computer monitor, and a user interface, such as a keyboard, mouse, touch screen, or the like for allowing an operator thereof to send and receive information to and from the pressure sources 26,28 or any actuation components, support components, and/or sensors associated with the part forming apparatus 10.

In some embodiments of the invention, the control system 38 may further include and/or be communicably coupled with one or more servers (not shown) running Windows; LAMP (Linux, Apache HTTP server, MySQL, and PHP/Perl/Python); Java; AJAX; NT; Novel Netware; Unix; or any other software system. The control system 38 may also include conventional web hosting operating software, searching algorithms, an Internet connection, and may be assigned a URL and corresponding domain name so that it can be accessed via the Internet in a conventional manner.

The computer-readable memory of the control system 38 may include any data storage device or computer-readable medium, as described herein. In some embodiments of the invention, some or all of the computer-readable memory may be located remotely from the processor. One or more computer programs may be stored in or on the computer-readable medium and may be configured for being executed by the processor. The computer programs may comprise computer code or listings of executable instructions for implementing logical functions in the processor and/or other devices communicably coupled therewith and can be embodied in any non-transitory computer-readable medium for use by or in connection with an instruction execution system, apparatus, or device, such as a computer-based system, processor-containing system, or other system that can fetch the instructions from the instruction execution system, apparatus, or device, and execute the instructions. In the context of this application, a "computer-readable medium" can be any non-transitory means that can contain, store, or communicate the programs. The computer-readable medium can be, for example, but not limited to, an electronic, magnetic, optical, electro-magnetic, infrared, or semi-conductor system, apparatus, or device. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

In use, the rigid forming components 14,16 and their corresponding holding chambers 22,24 may be actuatable between a first open configuration, as illustrated in FIG. 3, and a second closed configuration, as illustrated in FIGS. 4 and 5. In the first open configuration, the formable material 12 may be placed between the rigid forming components 14,16 at a desired position. Then at least one of the rigid forming components 14,16 and their corresponding holding chambers 22,24 may be actuated, such as with the pressure source 28, into the second closed configuration, pressing the formable material 12 between the rigid forming components 14,16. While the formable material 12 is thus held in this desired position, the pressure source 26 may be activated to inflate the inflatable components 18,20, as illustrated in FIG. 5, and the heat source 30 may be heated to a desired temperature for forming the formable material 12. The inflation of the inflatable components 18,20 presses portions of the formable material 12 against one of the rigid forming components 14,16, thereby forming the flanges 32,34 between the inflatable components 18,20 and one of the rigid forming components 14,16. Once the formable material 12 has been held in this configuration for a desired forming time at a required temperature, the pressure sources 26,28 may be deactivated or even provide vacuum to deflate the inflatable components 18,20 and/or to actuate the rigid forming components 14,16, and their corresponding holding chambers 22,24 into the first open configuration, so that an operator can retrieve the formed part. In some embodiments of the invention, the formed part may then additionally be cured. Forming and curing may be performed sequentially and may require an additional heat source for curing after the material is formed. Alternatively, the forming and curing may be performed substantially simultaneously using the heat source 30 and/or the additional heat source.

Figure 6:
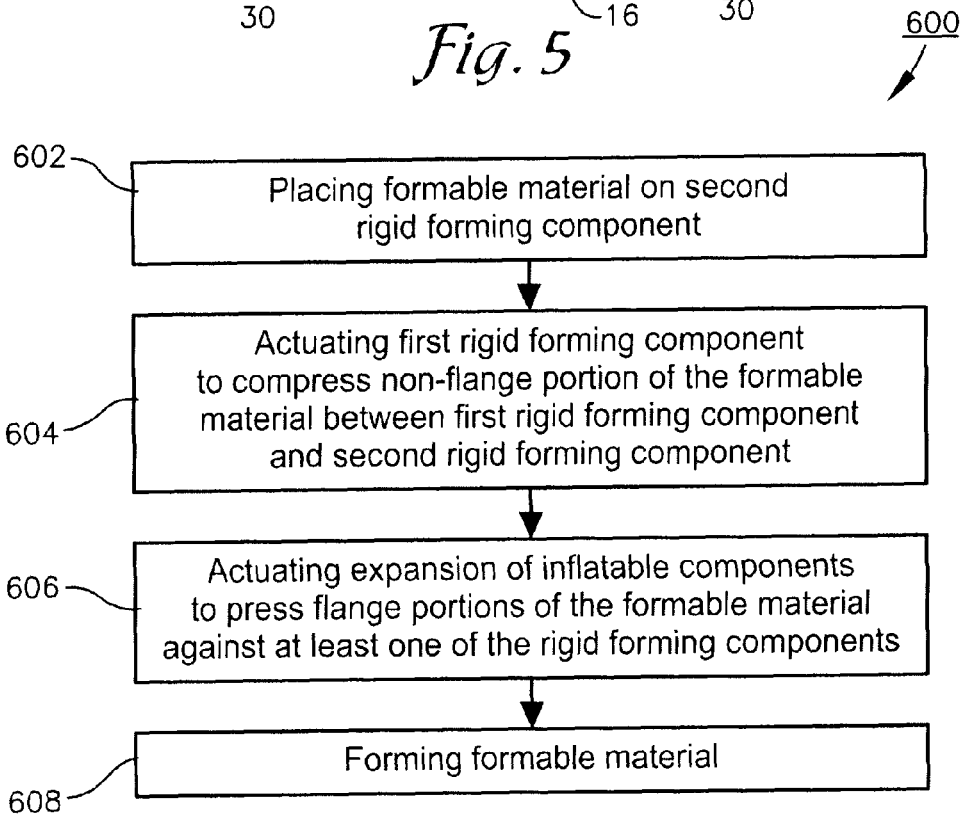
FIG. 6 is a flow chart illustrating a method of forming a rigid part in accordance with embodiments of the present invention.

A method 600 for manufacturing an aircraft part or a composite part using the part forming apparatus 10 disclosed herein will now be described in more detail, in accordance with various embodiments of the present invention. The steps of the method 600, as shown in FIG. 6, may be performed in the order or they may be performed in a different order. Furthermore, some steps may be performed concurrently as opposed to sequentially. In addition, some steps may not be performed. One or more of the steps may represent computer program modules or code segments executable by the processor of the control system 38 described above.

As illustrated in FIG. 6, the method 600 may include a step of placing the formable material 12 on at least one of the rigid forming components 14,16, as depicted in block 602. For example, the rigid forming components 14,16 and/or their corresponding holding chambers 22,24 may be in the first open configuration, and an operator may place the formable material onto the second rigid forming component 16, with portions for forming one or more flanges 32,34 extending outward from one or more edges of the second rigid forming component 16, as illustrated in FIG. 3.

Next, the method 600 may include a step of actuating the first rigid forming component 14 to compress the non-flange portion 36 of the formable material 12 between the first rigid forming component 14 and the second rigid forming component 16, as depicted in block 604. This actuation may be triggered by an operator or by the control system 38 described herein. As described above, one of the pressure sources 26,28 may be activated to hydraulically actuate the first rigid forming component 14 and/or its corresponding holding chamber 22 to move toward and apply pressure to the formable material 12. The amount of pressure applied may depend on requirements of the part being formed. In other embodiments of the invention, this compression of the non-flange portion 36 of the formable material 12 may be accomplished using other manual or automated techniques and devices to actuate the first rigid forming component and/or its corresponding holding chamber 22 without departing from the scope of the invention.

Subsequently or simultaneously, the method 600 may include a step of actuating expansion of at least one of the inflatable components 18,20 to press flange portions (i.e., flanges 32,34) of the formable material 12 against at least one of the rigid forming components 18,20, as depicted in block 606. So, for example, the first pressure source 26 may be turned on or otherwise activated (e.g., opening of a valve fluidly coupling the first pressure source 26 with the inflatable components 18,20) by an operator or by the control system 38 described herein, causing the inflatable components 18,20 to stretch and expand while filling up with air or any other gas. In the embodiments of the invention illustrated in FIGS. 3-5, the shape of the holding chambers 22,24 confine the inflatable components 18,20, such that they are only allowed to expand in a direction toward the formable material 12, thus pressing the flanges 32,34 against the second rigid forming component 16.

However, the inflatable components 18,20 may be mounted or otherwise fixed in any desired configuration relative to the rigid forming components 14,16 and the holding chambers 22,24. Specifically, any configuration of the inflatable components 18,20, in cooperation with any shape and configuration of the rigid forming components 14,16 and any confinement provided by the holding chambers 22,24, may be used so as to press and hold various edge portions of the formable material 12 against surfaces of one of the rigid forming components 14,16 to form any flanges of any desired size and angle. For example, this method 600 may be used to form C-shaped channel flanges, U-shaped channel flanges, single L-shaped flanges, opposing Z-shaped channel flanges, or any other flange configurations known in the art.

Finally, the method 600 may include a step of forming and/or curing the formable material 12 with the heat source 30 and/or an alternate heat source 30, as depicted in block 608, while the formable material 12 is pressed between the inflatable components 18,20 and at least one of the rigid forming components 14,16. For example, the heat source 30 may be triggered by an operator or by the control system 38 described herein to heat up to a desired forming temperature for the formable material 12 (e.g., composite cure temperature). As described above, the heat source 30 may provide heat to the formable material 12 in any way known in the art, such as IR heaters fixed to one or both of the rigid forming components 18,20 and/or one or both of the holding chambers 22,24.

Advantageously, the part forming apparatus 10 prevents undesirable wrinkling and buckling, particularly when forming arced single L flanges, opposing Z-flanges, or C flanges, as in the embodiment of the invention illustrated in FIGS. 1-5. In particular, the part forming apparatus 10 allows the forming of these curved flanges in one operation by preventing compressive forces from distorting the formable material's original in-plane fiber or material alignment out of plane. For example, when forming a perpendicular arc surface out of a flat composite prepreg material over a curved mandrel, an inner arc of the formable material reacts to tension when downward force is applied to force it to a smaller arc or curved surface. In prior art methods, since there is insufficient restriction or counter force to this, the inner arc or bend radius reacts to the tension by compressing adjacent material, forming wrinkles. The part forming apparatus 10 described herein prevents the compressive forces from reacting to the tension, so that the formable material 12 forms to the inner arc without wrinkling the adjacent material, thereby forming the perpendicular or angled flange.

Alternative Embodiments

In some alternative embodiments of the invention, as illustrated in FIGS. 7-8, a part forming apparatus 110 may be used to form a formable material 112, which is substantially identical to the formable material 12 described above. Likewise, the part forming apparatus 110 may be substantially identical to the part forming apparatus 10 described above, except that the inflatable components 18,20 may be replaced with a single sheet of inflatable material 150, which may be sealed to at least one holding chamber 122,124. The holding chambers 122,124 illustrated in FIGS. 7-8 may be substantially identical to the holding chambers 22,24 described above. Likewise, the part forming apparatus 110 may comprise rigid forming components 114,116 that are substantially identical to the rigid forming components 14,16 described above, as well as pressure sources 126,128 and a heat source 130 that are substantially identical to the pressure sources 26,28 and the heat source 30, respectively, as described above.

As illustrated in FIG. 7, the sheet of inflatable material 150 and the holding chamber 122 may cooperatively form an air-tight chamber around the rigid forming component 114. Specifically, the sheet of inflatable material 150 may be sealed to at least one of the holding chambers 122,124, and the pressure source 126 may be fluidly coupled to the sheet of inflatable material and/or at least one of the holding chambers 122,124.

In use, the holding chambers 122,124 are actuated toward each other, creating an air-tight seal between the sheet of inflatable material 150 and each of the holding chambers 122,124. Then one of the pressure sources 126,128 may be activated to create a pressure differential between the holding chamber 122 and the holding chamber 124. This may be accomplished via vacuum of atmosphere in the holding chamber 124 and/or via air forced into holding chamber 122 (via one of the pressure sources 126,128), inflating the inflatable material 150 in a direction toward the holding chamber 124, thereby bending portions of the formable material 112 into two flanges 132,134.

Figure 9:
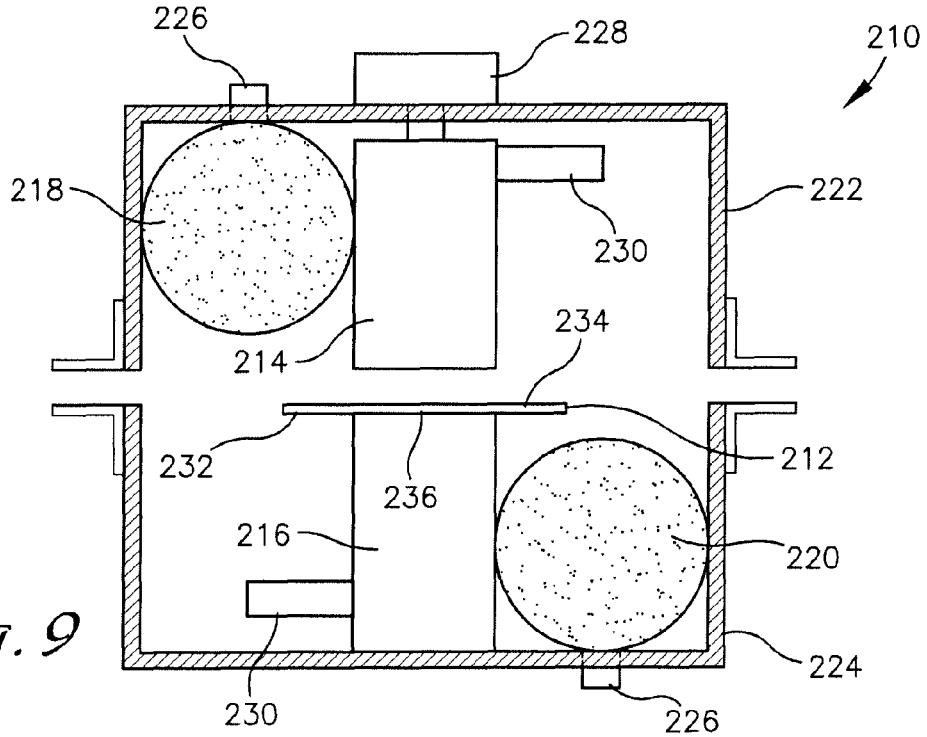
FIG. 9 is a schematic cross-sectional view of another alternative embodiment of the part forming apparatus of FIG. 3, with the two inflatable components located in opposite holding chambers in a configuration for forming a Z-channel part.

In yet another alternative embodiment of the invention, as illustrated in FIG. 9, a part forming apparatus 210 may be substantially identical to the part forming apparatus 10, except for some of the components thereof being rearranged to result in a part having a Z-shaped cross-section (i.e., a cross-section with two end flanges extending in substantially opposite directions). Specifically, the part forming apparatus 210 may comprise two rigid forming components 214,216, one or two inflatable components 218,220, one or two holding chambers 222,224, one or more pressure sources 226,228, and at least one heat source 230 substantially identical to components 14, 16, 18, 20, 22, 24, 26, 28, and 30, respectively.

However, in this embodiment of the invention, as illustrated in FIG. 9, one of the inflatable components 218 may be mounted in fixed relation to one of the holding chambers 222 and/or its corresponding rigid forming component 214, while the other of the inflatable components 220 may be mounted in fixed relation to the other of the two holding chambers 224 and/or its corresponding rigid forming component 216. Furthermore, the heat source 230 may comprise two heating elements 252,254 and/or may be two distinct heat sources. That is, one of the heating elements 252 may be fixed in one holding chamber 222 and the other of the heating elements 254 may be fixed in the other holding chamber 224.

During inflation in FIG. 9, the inflatable components 218,220 inflate and thus expand in opposite directions, due to their location and available space provided by the holding chambers 222,224. Thus, the forming material 212 is formed with flanges extending in two opposite directions. The heating elements 252 and 254 are located on opposite sides of the rigid forming components 214,216 from the inflatable components 218,220 and provide heat near each of the formed flanges and to the rigid forming components 214,216 to which they are adjacent and/or attached.

In yet another alternative embodiment of the invention, as illustrated in FIGS. 10 and 11, a part forming apparatus 310 may be substantially identical to the part forming apparatus 110, but may omit one of the rigid forming components 114. Specifically, the part forming apparatus 310 for forming a formable material 312 may include one rigid forming component 316, a sheet of inflatable material 350, one or two holding chambers 322,324, one or more pressure sources 326,328, and at least one heat source 330 substantially identical to the formable material 12 and the components 16, 150, 22, 24, 26, 28, and 30, respectively, of other embodiments described above. When inflated via the pressure source 326, the sheet of inflatable material 350 may first compress a non-flange portion 336 of the formable material 312, as illustrated in FIG. 10, thereby creating a positive pressure to stabilize and hold the formable material 312 onto the rigid forming component 316. Then, as the pressure source 328 further moves the holding chambers 322,324 into a closed configuration, as illustrated in FIG. 11, both flanges 332,334 and the non-flange portion 336 of the formable material 312 is compressed against the rigid forming component 316.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A method of manufacturing an aircraft part from formable material, the method comprising the steps of:

placing the formable material on a rigid forming component comprising an elongated arc-shaped compression block;

actuating expansion of an inflatable component, such that the inflatable component presses flange portions of the formable material against the rigid forming component;

forming the formable material while the formable material is pressed between the inflatable component and the rigid forming component.

2. The method of claim 1, wherein the rigid forming component comprises a first rigid forming component and a second rigid forming component, the method further comprising a step of actuating the first rigid forming component to compress a non-flange portion of the formable material between the first rigid forming component and the second rigid forming component prior to the step of actuating expansion of the inflatable component.

3. The method of claim 2, wherein the inflatable component comprises a hollow bladder made of inflatable material.

4. The method of claim 2, wherein the inflatable component comprises two hollow bladders made of inflatable material, wherein a first one of the two hollow bladders is mounted in fixed relation to the first rigid forming component and a second one of the two hollow bladders is mounted in fixed relation to the second rigid forming component.

5. The method of claim 2, wherein the inflatable component comprises two hollow bladders made of inflatable material, wherein both of the two hollow bladders are mounted in fixed relation to the first rigid forming component and located at opposing sides of the first rigid forming component.

6. The method of claim 1, wherein the inflatable component comprises one sheet of inflatable material sealed to a holding chamber, wherein a pressure source fluidly coupled to the one sheet of inflatable material and the holding chamber actuates inflation of the one sheet of inflatable material, thereby pressing the flange portions of the formable material against the rigid forming component during the step of actuating expansion of the inflatable component.

7. The method of claim 2, wherein the inflatable component comprises one sheet of inflatable material sealed to a holding chamber, wherein the first rigid forming component is located between the holding chamber and the inflatable material, such that both the non-flange portion of the formable material and a portion of the one sheet of inflatable material is compressed between the first rigid forming component and the second rigid forming component, wherein the step of actuating expansion of the inflatable component further comprises triggering a pressure source to inflate the one sheet of inflatable material, thereby pressing the flange portions of the formable material against the second rigid forming component.

8. The method of claim 1, wherein the step of forming the formable material and actuating expansion of the inflatable component is triggered by at least one of a heat source and a pressure source receiving command signals from a control system.

9. The method of claim 1, wherein the formable material comprises at least one of uncured composite material, thermal plastic, aluminum, and formable metal.

10. A part forming apparatus for shaping a formable material into a rigid part having angled flanges, the part forming apparatus comprising:

two holding chambers actuatable between a first open configuration and a second closed configuration in which the two holding chambers cooperatively form a single substantially enclosed holding chamber;

two rigid forming components, each fixed within one of the two holding chambers and configured to compress the formable material when the two holding chambers are in the second closed configuration with the formable material disposed between the two rigid forming components;

a first pressure source;

an inflatable component fixed relative to at least one of the rigid forming components and at least one of the holding chambers, wherein the component is fluidly coupled with the first pressure source for inflation thereof when the two holding chambers are in the second closed configuration; and a heat source configured to cure the formable material when the two holding chambers are in the second closed configuration and the inflatable component is at least partially inflated.

11. The part forming apparatus of claim 10, further comprising a second pressure source configured to actuate at least one of the holding chambers into the second closed configuration and to maintain the second closed configuration for a length of time.

12. The part forming apparatus of claim 10, wherein the two rigid forming components comprise a first rigid forming component and a second rigid forming component, and the first rigid forming component is actuatable to compress a non-flange portion of the formable material between the first rigid forming component and the second rigid forming component.

13. The part forming apparatus of claim 10, wherein the inflatable component comprises two hollow bladders made of inflatable material and mounted within at least one of the holding chambers on opposing sides of the rigid forming components, the hollow bladders being positioned within the holding chambers to press the formable material against one of the rigid forming components when the holding chambers are in the second closed configuration and the hollow bladders are at least partially inflated, thereby forming flanges at edges of the formable material in a C-channel, single L channel, or opposing Z-channel configuration.

14. The part forming apparatus of claim 10, further comprising a control system configured to send command signals to the first pressure source instructing the first pressure source to inflate the inflatable component and configured to send command signals to the heat source instructing the heat source to heat up to a programmed cure temperature for a programmed length of time.

15. A part forming apparatus for shaping a formable material into a rigid part, the part forming apparatus comprising:

a rigid forming component sized and shaped according to a desired size and shape of a surface of the rigid part, the rigid forming component comprising a first rigid forming component and a second rigid forming component;

a holding chamber;

an inflatable sheet sealed to the holding chamber, at least one of the first rigid forming component and the second rigid forming component being mounted to the holding chamber between the inflatable sheet and the holding chamber, the first rigid forming component being actuatable to compress the inflatable sheet and a non-flange portion of the formable material between the first rigid forming component and the second rigid forming component, wherein the inflatable sheet is configured to be fluidly coupled with a pressure source for inflation thereof, wherein the inflatable sheet, when at least partially inflated, presses toward and against the rigid forming component.

16. The part forming apparatus of claim 15, further comprising the pressure source, wherein the pressure source is fluidly coupled to at least one of the inflatable sheet and the holding chamber to actuate inflation of the inflatable sheet, thus pressing flange portions of the formable material against the rigid forming component when at least partially inflated via the pressure source.

17. The part forming apparatus of claim 15, further comprising the pressure source, wherein the pressure source is fluidly coupled to at least one of the inflatable sheet and the holding chamber to actuate inflation of the inflatable sheet, thus pressing flange portions of the formable material against the second rigid forming component when at least partially inflated via the pressure source.

18. A method of manufacturing an aircraft part from formable material, the method comprising the steps of:

placing the formable material on a rigid forming component comprising a first rigid forming component and a second rigid forming component;

actuating the first rigid forming component to compress a non-flange portion of the formable material between the first rigid forming component and the second rigid forming component;

after the first rigid forming component is actuated to compress the non-flange portion of the formable material, actuating expansion of an inflatable component comprising two hollow bladders made of inflatable material, both of the two hollow bladders being mounted in fixed relation to the first rigid forming component and located at opposing sides of the first rigid forming component, such that the inflatable component presses flange portions of the formable material against the rigid forming component; and forming the formable material while the formable material is pressed between the inflatable component and the rigid forming component.

* * * * *